US006783201B2

(12) United States Patent
Ninomiya

(10) Patent No.: US 6,783,201 B2
(45) Date of Patent: Aug. 31, 2004

(54) INK JET PRINTING APPARTUS FOR IDENTIFYING EJECTION ERROR

(75) Inventor: Takayuki Ninomiya, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/884,087

(22) Filed: Jun. 20, 2001

(65) Prior Publication Data

US 2002/0021313 A1 Feb. 21, 2002

(30) Foreign Application Priority Data

Jun. 21, 2000 (JP) ..... 2000-186951

(51) Int. Cl.[7] ..... B41J 25/308; B41J 23/00; B41J 29/393

(52) U.S. Cl. ..... 347/8; 347/37; 347/19

(58) Field of Search ..... 347/8, 37, 19

(56) References Cited

U.S. PATENT DOCUMENTS

| | | | | | |
|---|---|---|---|---|---|
| 4,313,124 | A | | 1/1982 | Hara | |
| 4,345,262 | A | | 8/1982 | Shirato et al. | |
| 4,459,600 | A | | 7/1984 | Sato et al. | |
| 4,463,359 | A | | 7/1984 | Ayata et al. | |
| 4,558,333 | A | | 12/1985 | Sugitani et al. | |
| 4,723,129 | A | | 2/1988 | Endo et al. | |
| 4,740,796 | A | * | 4/1988 | Endo et al. | 347/56 |
| 5,193,918 | A | * | 3/1993 | Lohrmann et al. | 400/56 |
| 5,227,809 | A | * | 7/1993 | Carpenter et al. | 347/8 |
| 5,414,453 | A | * | 5/1995 | Rhoads et al. | 347/8 |
| 5,468,076 | A | * | 11/1995 | Hirano et al. | 400/59 |
| 5,518,323 | A | * | 5/1996 | Sakaino et al. | 400/55 |
| 5,608,430 | A | * | 3/1997 | Jones et al. | 347/8 |
| 5,857,784 | A | * | 1/1999 | Allen | 400/74 |
| 5,975,666 | A | * | 11/1999 | Kawaguchi | 347/8 |
| 5,988,784 | A | * | 11/1999 | Takemura et al. | 347/8 |
| 6,172,688 | B1 | | 1/2001 | Iwasaki et al. | |
| 6,267,519 | B1 | * | 7/2001 | Otsuki et al. | 400/283 |
| 6,273,536 | B1 | * | 8/2001 | Nozawa | 347/8 |

FOREIGN PATENT DOCUMENTS

| | | | | |
|---|---|---|---|---|
| JP | 54-99438 | | 8/1979 | |
| JP | 2-184440 | | 7/1990 | |
| JP | 03183555 | A * | 8/1991 | B41J/2/01 |
| JP | 7-25006 | | 1/1995 | |
| JP | 7-47747 | | 2/1995 | |
| JP | 9-109460 | | 4/1997 | |
| JP | 2000-15788 | | 1/2000 | |
| JP | 2001-260328 | | 9/2001 | |

* cited by examiner

*Primary Examiner*—Lamson Nguyen
*Assistant Examiner*—Leonard Liang
(74) *Attorney, Agent, or Firm*—Fitzpatrick, Cella, Harper & Scinto

(57) ABSTRACT

This invention provides a printing apparatus which has an ink ejection head capable of forming an image at high resolution and still can reliably identify a location where an ink ejection error has occurred without using an expensive image reading device. This printing apparatus has a distance adjusting device to change a distance between the ink ejection head and the print medium, and a controller to set a plurality of different distances by controlling the distance adjusting device. The controller controls the distance adjusting device to selectively set either a first distance that produces a normal printed image having within a predetermined range a landing error on the print medium of ink droplets ejected from the print head or a second distance that produces a landing error greater than the predetermined range.

11 Claims, 7 Drawing Sheets

INK JET PRINTING APPARTUS FOR IDENTIFYING EJECTION ERROR

This application is based on Patent application No. 2000-186951 filed Jun. 21, 2000 in Japan, the content of which is incorporated hereinto by reference.

BACKGROUND OF THE INVENTION

1. Field of the Invention

The present invention relates to a printing apparatus applied to copying machines, printers, word processors and facsimiles and more specifically to a printing apparatus with a print head capable of ejecting ink droplets.

2. Description of the Related Art

Printing apparatuses with functions of a printer, copying machine and facsimile machine and printing apparatuses used as output devices for combination type electronic apparatuses including computers and word processors and for work stations are all designed to record an image on printing media, such as paper and plastic thin plates, according to image data. Such printing apparatuses can be classed into an ink jet type, wire dot type, thermal type and laser type according to the printing method. The ink jet type printing apparatus (ink jet printing apparatus) ejects ink from nozzles of an ink ejection means such as a print head onto a print medium to form an image and has a variety of advantages.

They include abilities to reduce the size of the ink ejection means, print a very fine image at high speed and print on plain paper without requiring a special treatment on the paper, a low running cost, low noise because of the non-impact printing method, and an ease with which a color image can be formed using multicolor inks. Particularly in a print head using a so-called bubble jet printing method that utilizes thermal energy in ejecting ink, liquid passages can easily be arranged at high densities (high density nozzle arrangement) by using a semiconductor manufacturing process including etching, vapor deposition and sputtering. This in turn leads to a further reduction in size.

Even in this ink jet printer the ink droplets are not necessarily ejected in a constant direction at all times. That is, the ink ejection direction may vary from one nozzle to another depending on wet conditions of the ink ejection ports, conditions of paper dust adhering to the ink ejection ports and shape differences among the ink ejection ports.

During printing at a maximum density, i.e., in a 100% duty printing condition, any error (deviation) in the ink ejection direction easily shows up. This ejection direction deviation results in blank lines appearing in a solid-printed image, i.e., a color of the print medium itself showing through. Hence, the image formed with ink is so designed that the above-described problem of blank lines on a printed image does not occur if the ink ejection direction deviation is within a predetermined value. One of such blank line prevention means increases an ink penetration area on the paper so that slight ejection direction deviations will not produce blank lines.

Even with such means provided, in the event that ink ejection direction deviations exceed the ink penetration area, image failures called blank lines may result. Identifying the nozzles that cause such ejection direction deviations is as important as taking measures for correcting the ejection direction deviations of these nozzles. The identifying of the faulty ejection nozzles is becoming harder than ever because the resolution of the printed image in recent years is as high as 600 dpi to 1440 dpi and the area in which an ink droplet can seep after landing on the print medium is becoming increasingly smaller. In a printing apparatus employing binary representation, the miniaturization of the ink droplet (print dot) is particularly important in terms of eliminating the granular appearance of ink dots and enhancing an image quality The ink droplet miniaturization, however, makes the identifying of faulty ink ejection nozzles more difficult.

A conventional method of detecting a deviation of ink ejection direction involves setting constant a distance between a print medium and ink ejection nozzles (simply referred to as nozzles), ejecting ink from the nozzles onto the print medium to print an image, measuring a distance from a predetermined reference ejection position to a position of a resulting blank line, and identifying a deviated nozzle according to the measured distance.

With the conventional nozzle identification method, however, because the print medium and the nozzles are set to have a distance or positional relation that optimizes the printed image quality, i.e., the positional relation that minimizes the deviation, an apparatus for measuring the deviated position needs to be a high-performance image reading device. This is because an increased resolution makes the ink seeping area forming a printed dot smaller and the measurement of density variations among the printed dots requires the use of a measuring device with a resolution several times higher than that of the printed dots.

SUMMARY OF THE INVENTION

The present invention has been accomplished to overcome the problems of the conventional technique described above. It is an object of the invention to provide a printing apparatus which has an ink ejection means capable of forming an image at high resolution and still can reliably identify a location where an ink ejection error has occurred without using an expensive image reading device.

To solve the problems above, the present invention has the following construction.

According to a first aspect, the invention provides a printing apparatus for ejecting ink droplets from an ink ejection means onto a print medium to form an image, the printing apparatus comprising: a distance adjusting means to change a distance between the ink ejection means and the print medium; and a control means to set a plurality of different distances by controlling the distance adjusting means; wherein the control means controls the distance adjusting means to selectively set either a first distance that produces a normal printed image or a second distance.

In the invention above, the first distance may be a distance that produces a normal printed image having within a predetermined range a landing error (deviation from a landing position) on the print medium of ink droplets ejected from the print head, and the second distance may be a distance that produces a landing error greater than the predetermined range.

In the invention above, the first distance may be a distance that produces a normal printed image and the second distance may serve as a print position for producing a printed image and as a distance for observing a landing error of the ink droplets.

According to another aspect, the invention provides a printing apparatus for ejecting ink droplets from an ink ejection means onto a print medium to form an image, the printing apparatus comprising; a distance adjusting means to change a distance between the ink ejection means and the print medium; and a control means to set a plurality of different distances by controlling the distance adjusting means; wherein the control means controls the distance adjusting means to selectively set either a plurality of first distances that produce a normal printed image having within a predetermined range a landing error on the print medium of ink droplets ejected from the print head or a plurality of second distances that produce a landing error greater than the predetermined range.

In the invention above, the first distance may be a distance that produces a normal printed image and the second distance may serve as a print position for producing a second printed image and as a distance for observing a landing error of the ink droplets.

Further, in the invention above, it is desired that the first distance be a distance such that adjacent ink droplets join through a penetration of ink as a result of the landing error and that the second distance be a distance such that an unpenetrated ink area is formed between the adjacent ink droplets as a result of the landing error.

In the invention above, when the ink droplet ejection error characteristic of the ink ejection means is to be measured, a measurement command is entered into the control means. In response to this command, the control means controls the distance adjusting means to shift the distance between the print medium and the ink ejection means from the distance position that produces a normal printed image. Performing the printing operation under this condition results in a large landing error of ink droplets due to the ink ejection direction deviation. This causes a significant image degradation and thus allows the user to identify a portion of the ink ejection means that has caused the ejection error. When the user wishes to form a normal printed image, the user enters a predetermined print command from an input device. As a result, the control means controls the distance adjusting means to form an appropriate printed image that has no large landing errors.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described.

Figure 1:
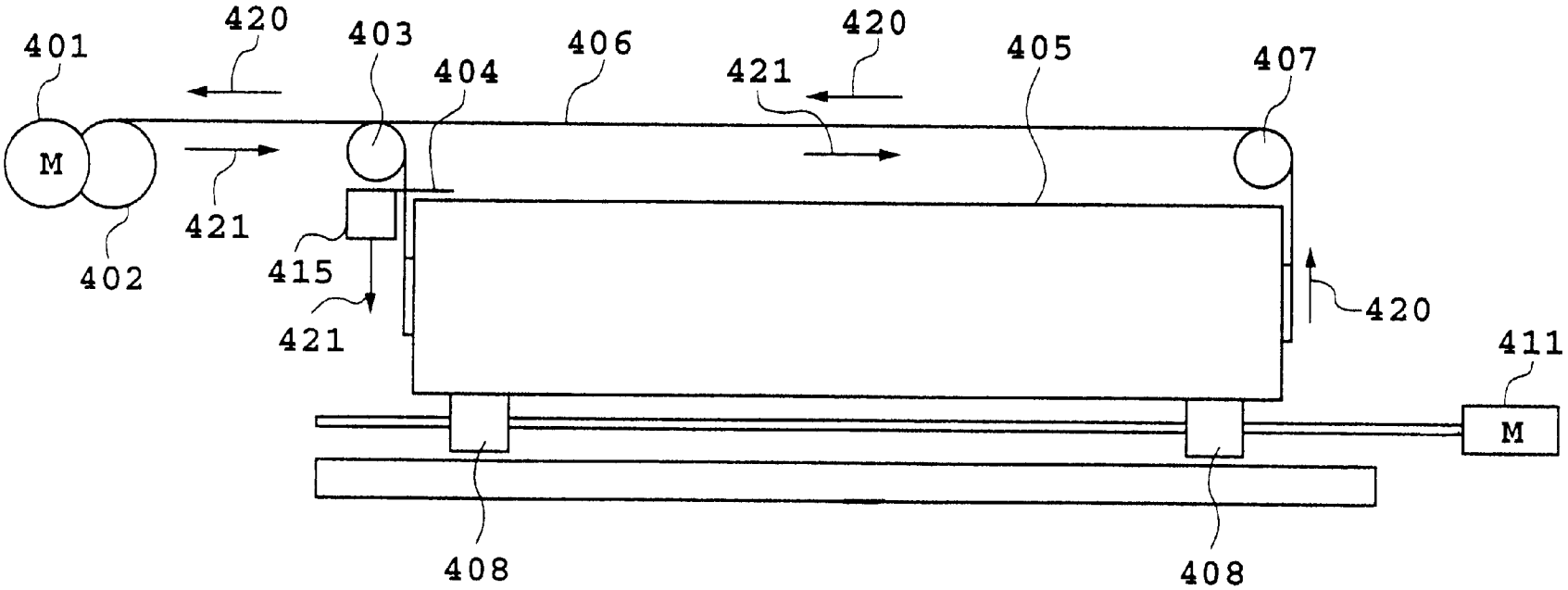
FIG. 1 is a side view, as seen from a print medium feeding direction, showing a positional relation between a print head and a print medium in a first embodiment of the invention.
Figure 2:
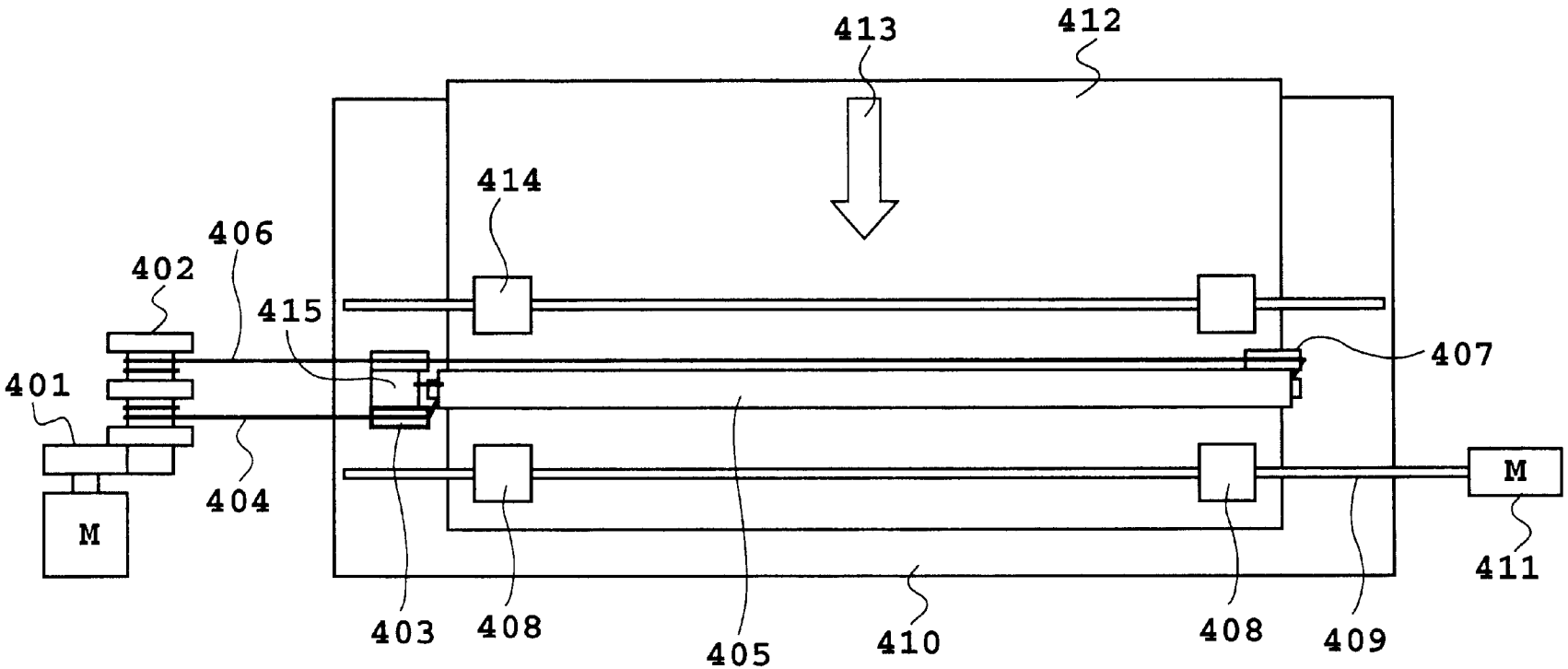
FIG. 2 is a plan view of that of FIG. 1 as seen from above in a direction perpendicular to the print medium feeding direction.

FIG. 1 and FIG. 2 show an ink jet printing apparatus applying this invention. FIG. 1 is a side view as seen from a print medium feeding direction, FIG. 2 is a plan view of FIG. 1 as seen from above in a direction perpendicular to the print medium feeding direction.

In the figure, denoted by 405 is a print head in which an array of nozzles extending along a direction (preferably, an orthogonal direction) intersecting a print medium feeding direction (sub-scanning direction) is arranged. The print head 405 employs a so-called bubble jet method that ejects ink by thermal energy. The print head is suspended at its left end by a wire 404 and at its right end by a wire 406. The left-end wire 404 is wound up through a roller 403 by a wire take-up roller 402 and the right-end wire 406 is wound up through a roller 407 by the wire take-up roller 402. The wire take-up roller 402 winds or unwinds the wire by the rotation of a print head vertical control motor 401. A head home position sensor 415 that sets a reference position of the print head 405 is arranged at the left end of the print head 405. The head home position sensor 415 determines the reference position based on a distance between the ink ejection face of the print head 405 and the print medium.

The print medium 412 is fed in a sub-scan direction (direction of arrow 413) by feed rollers 408 which are driven by a feed motor 411. Print medium retaining rollers 414 are used to prevent the print medium from floating.

In the above construction, rotating the head vertical control motor 401 to wind the wires 404 and 406 in a direction of arrow 420 can move the print head 405 away from the print medium. Rotating the head vertical control motor 401 to move the wires 404 and 406 in a direction of arrow 421 can move the print head 405 toward the print medium.

In the above construction, the distance between the print head 405 and the print medium 412 can be adjusted by the head vertical control motor 401 after the distance has been set by the head home position sensor 415. The head vertical control motor 401 uses a motor whose rotation angle can be controlled, such as a pulse motor, and thus can stop the print head 405 at any desired position. The head vertical control motor 401, wires 404, 406 and wire take-up roller 402 constitute a distance adjusting means.

Figure 3:
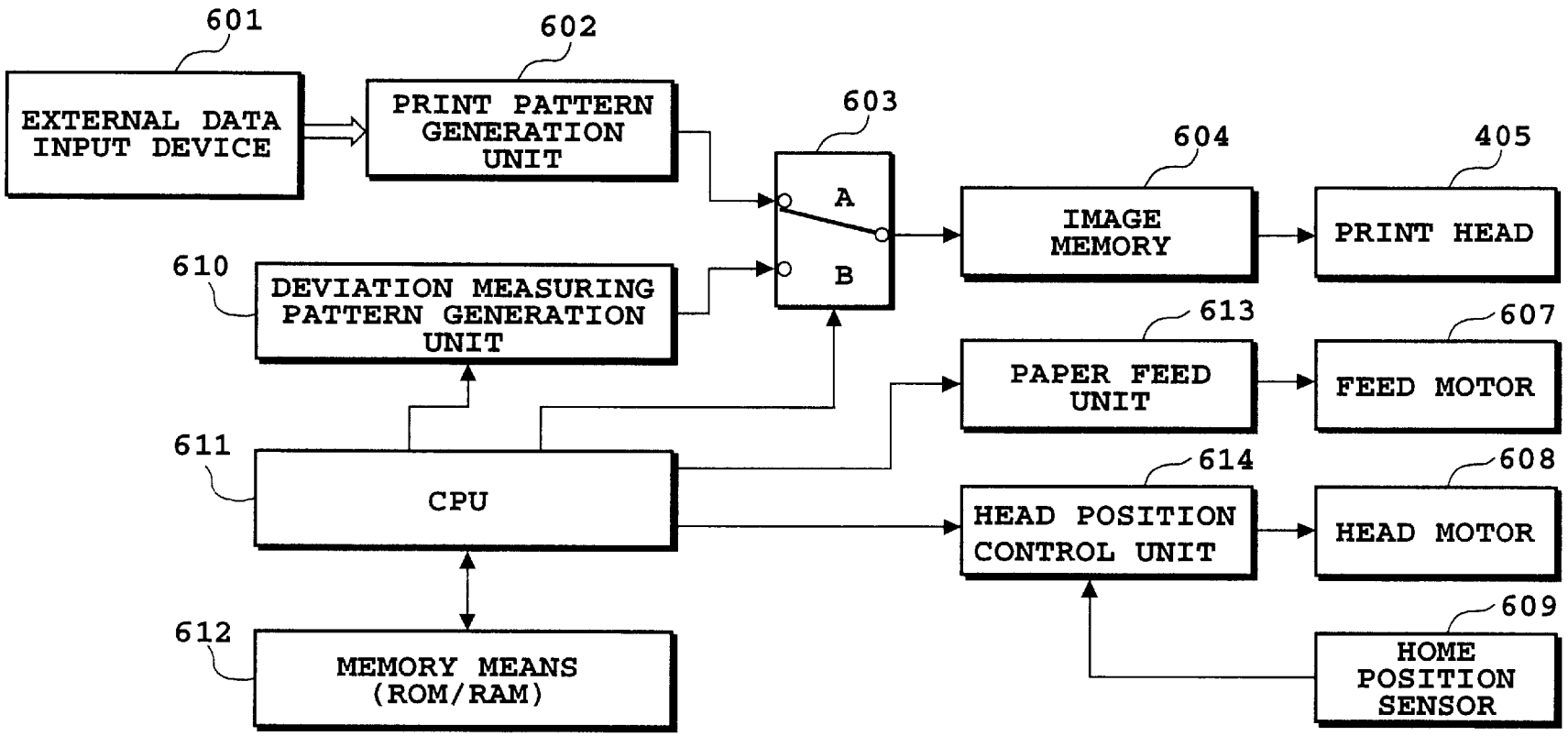
FIG. 3 is a block diagram showing a configuration of a control system in the first embodiment of the invention.

FIG. 3 shows an electrical block diagram for operating the mechanism described above.

In the figure, various drive portions in the above mechanism are controlled by a CPU (control means) 611. The CPU 611 performs controls according to control codes whose operation information is stored in a memory means 612 including a ROM and a RAM. In FIG. 3, normal print data is taken in by an external data input device 601, from which it is fed into a print pattern generation unit 602 of the printing apparatus where the print data is converted into print image data suited for printing. The print image data in the print pattern generation unit 602 is picked up by a switch 603 connecting to a contact A and stored in an image memory 604.

With the print data stored in the image memory 604, the CPU 611 sends home position information on the print head 405 from a home position sensor 609 of the print head to a head position control unit 614.

Except when the print head 405 is at the home position, the rotation of a head motor 608 is controlled to move the print head 405 to the home position. Then, a print position control is performed to rotate the head motor 608 to locate the print head at the print position. When the print head 405 reaches the print position, the CPU 611 starts a feed motor 607 to feed the print medium. When the rotation of the feed motor 607 is stabilized, the print data is transferred from the image memory 604 to the print head 405 in synchronism with the feeding of the print medium, printing one cluster at a time.

In this system, when a deviation measurement is to be made, the CPU 611 sends a trigger to a deviation measuring pattern generation unit 610. In response to this trigger, the deviation measuring pattern generation unit 610 sends a deviation measuring pattern to the image memory 604. At this time, the switch 603 is already set to the contact B side by the CPU 611. When the deviation measuring pattern is input to the image memory 604, the CPU 611 controls the head position control unit 614 to move the print head 405 to a deviation measuring position. By estimating when the print head 405 will reach the deviation measuring position or by forward-controlling the print head 405, the CPU 611 sends a control signal to a print medium feed unit 613 to drive the feed motor 607. When the rotation of the feed motor 607 stabilizes at a predetermined speed, the measuring pattern data is transferred from the image memory 604 to the print head 405, which prints the measuring pattern.

Figure 4:
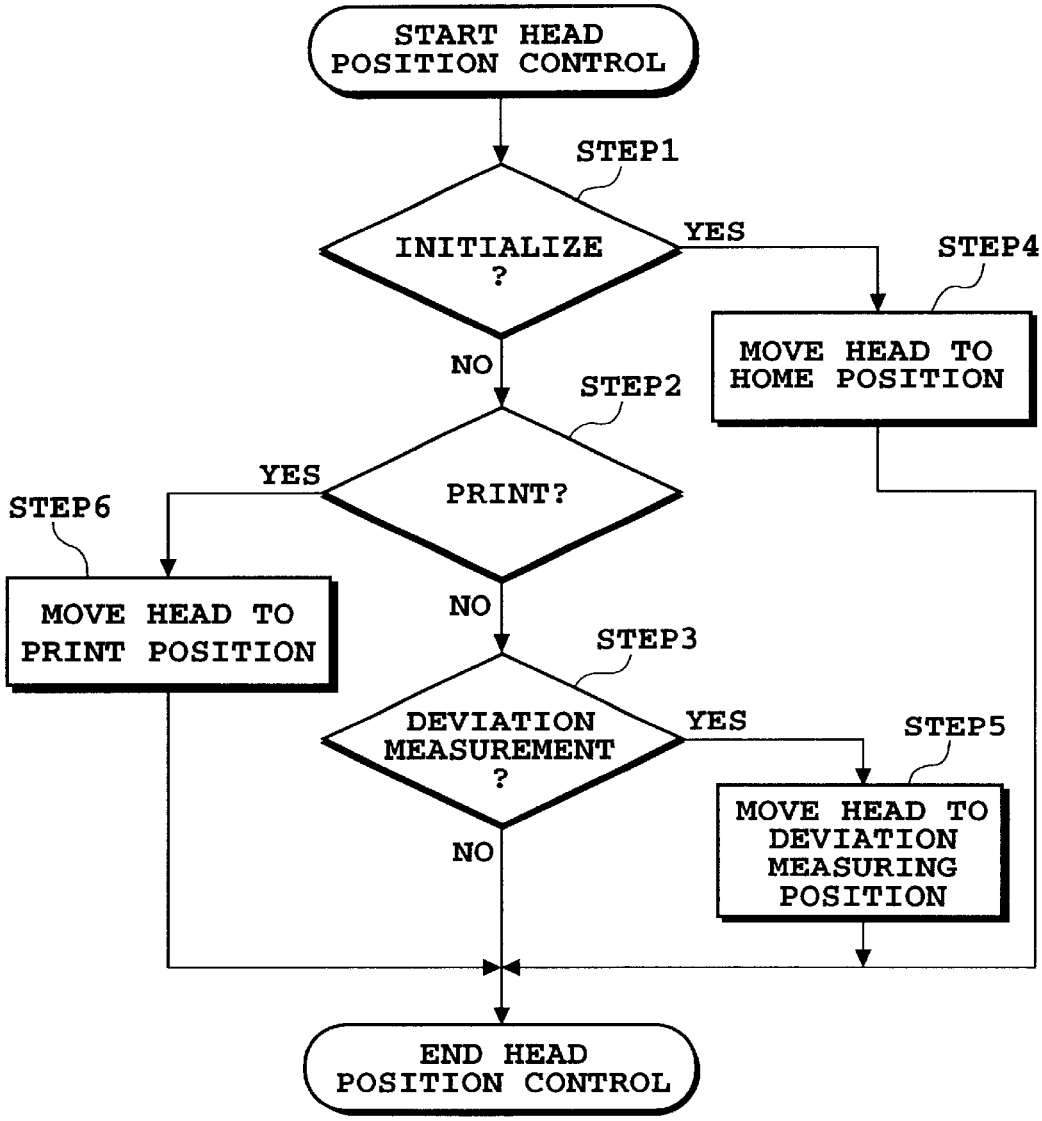
FIG. 4 is a flow chart showing a head position control.

Next, a head position control performed by the head position control unit 614 will be described by referring to the flow chart of FIG. 4.

In the flow chart, when an initialize command is received from the CPU 611, the head position control unit 614 moves the print head 405 to the home position according to the information from the home position sensor 609 (step 1, step 4). At the home position, the print head 405 is generally capped on its nozzles to keep it in good operational state. This nozzle-capping is not shown in the flow chart. Next, it is checked whether a print command is entered or not (step 2). When a print command is entered, the head position control unit 614 moves the print head 405 to a position 102 (see FIG. 5) corresponding to a distance (first distance) that is used to perform normal printing (step 6). At step 3 a check is made as to whether a deviation measurement command is received. If so, the head position control unit 614 moves the print head 405 to a position (deviation measuring first distance) 103 corresponding to a second distance, larger than the first distance for the normal printing (step 5).

Figure 5:
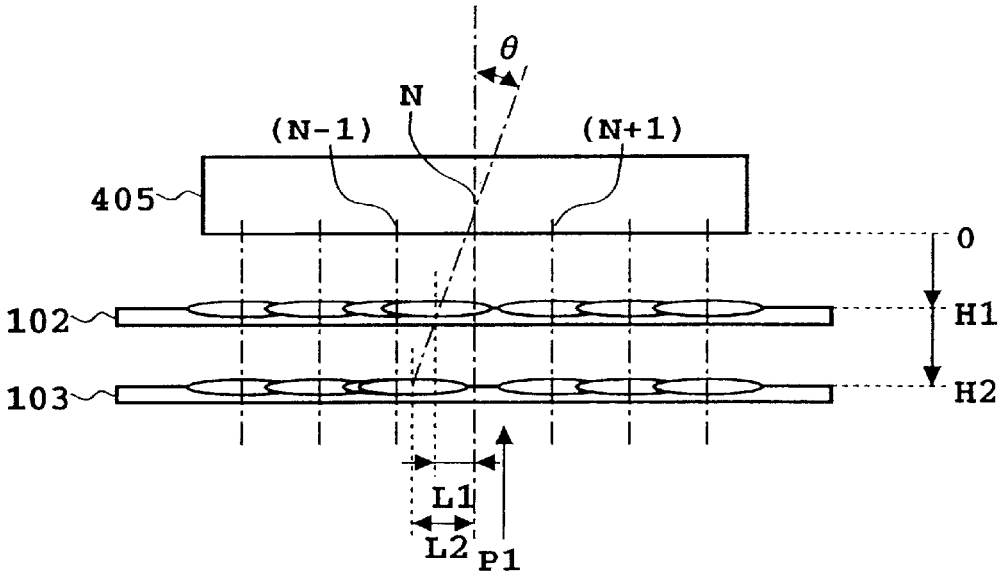
FIG. 5 is an explanatory side view showing an ink droplet landing on a print medium for each distance setting.

As described above, in the first embodiment, the distance between the print head 405 and the print medium 412 can be set to one of first distance H1 and second distance H2. The ink droplet landing positions for each distance setting are shown in FIG. 5. FIG. 5 represents a case where the ink ejection deviates in the nozzle column direction (sub-scan direction) resulting in a dot landing position error (i.e., a printed dot lands at a deviated position).

In the print head 405 of FIG. 5, N represents a nozzle with a deviated ink ejection, N−1 represents an adjacent nozzle to the left of the nozzle N and N+1 represents an adjacent nozzle to the right of the nozzle N. An ink droplet from the nozzle N is shown to be ejected at an angle θ toward the nozzle N−1 with respect to an intended direction of ejection to the print medium.

As for the position of the print medium, the normal print position is represented by 102 and the deviation measuring position by 103. The ink droplet from the nozzle N ejected at an ejection angle θ lands on the print medium situated at the normal print position which is a distance H1 from the print head 405. The deviation of the ink droplet landing position from the reference position is L1. When the print medium is situated at the deviation measuring position which is a distance H2 from the print head 405, the deviation of the ink droplet landing position from the reference position is L2. The relations between L1 and H1 and between L2 and H2 are expressed as follows using θ.

$$L1=H1\tan\theta$$

$$L2=H2\tan\theta$$

tanθ is a positive value and has the same magnitude in the two equations. Thus, if H2>H1, then L2 >L1. That is, by performing the printing with a distance H2 which is larger than the normal print distance H1, it is possible to detect an amplified deviation.

Figure 6A:
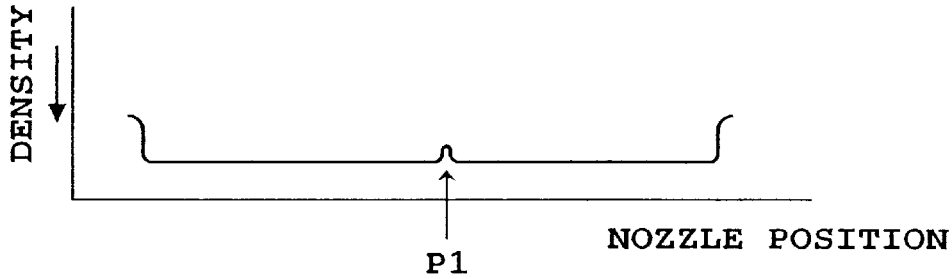
FIG. 6A shows a density variation of a printed image at normal print positions in the first embodiment of the invention.
Figure 6B:
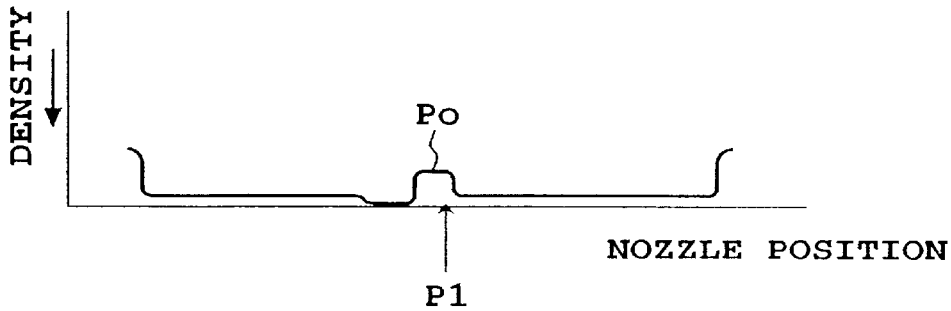
FIG. 6B shows a density variation of a printed image at deviation measuring positions in the first embodiment of the invention.

FIGS. 6A and 6B show examples of printed image density measurements in which ink is ejected from all nozzles of the print head 405 to print an image on the print medium and the density of the printed image is measured by a density meter. FIG. 6A shows density variations in an image printed at the normal print position 102. FIG. 6B shows density variations in an image printed at the deviation measuring position 103. As shown in the figures, when the printing is done at the normal print position 102, the penetration area of an ink droplet covers the deviation L1 and the density variation between the nozzle N and the nozzle (N+1) is minute.

When, on the other hand, the printing is done at the deviation measuring position 103, the density variation at the deviated dot position shows up more clearly than when the printing is done at the normal print position 102. At the nozzle position N, an unprinted portion P0 is generated by the ink droplet deviation. In this unprinted portion P0, a blank portion, i.e., the color of the print medium itself shows. Hence, by observing the print medium that was printed at the deviation measuring position 103, the user can recognize a blank portion and thereby easily determine the position of a nozzle that caused the ejection deviation. Therefore, the printing apparatus does not require an expensive measuring mechanism as the conventional apparatus does, and can realize a cost reduction.

In a portion of the nozzle position (N−1) where ink droplets overlap, a larger-than-normal amount of ink is applied increasing the density of that portion.

While in the above first embodiment the distance between print head and print medium is adjusted by vertically moving the print head 405, the distance adjustment is not limited to the means shown in the first embodiment but may use other means.

Figure 7A:
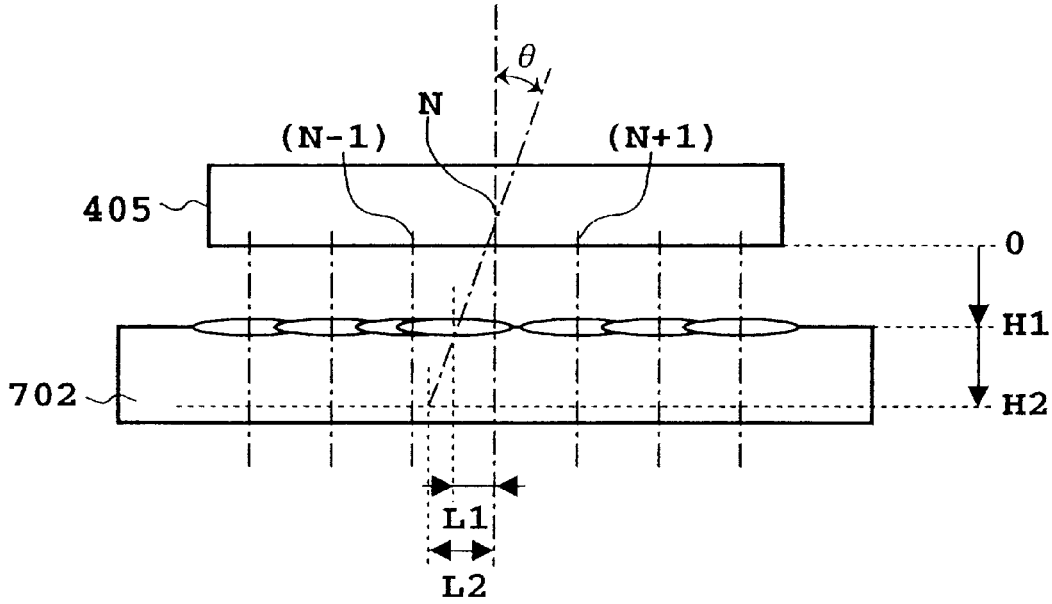
FIG. 7A is an explanatory side view showing an ink droplet landing at a normal print position for each distance setting in a second embodiment of the invention.
Figure 7B:
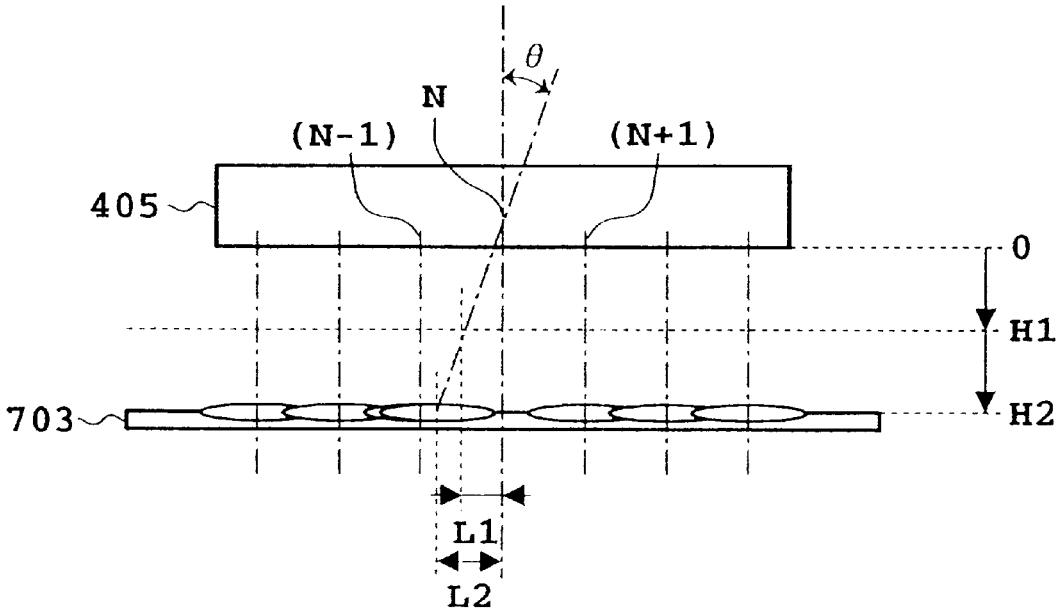
FIG. 7B is an explanatory side view showing an ink droplet landing at a deviation measuring position for each distance setting in a second embodiment of the invention.

For example, in a second embodiment shown in FIGS. 7A and 7B, the thickness of paper is changed between the deviation measurement and the normal printing to adjust the distance between print medium and print head. FIG. 7A represents a normal printing that uses a relatively thick print medium (thick paper) 702 and FIG. 7B represents a deviation measurement that uses a relatively thin print medium (thin paper) 703.

During the normal printing, the distance between the thick paper and the print head is kept at an appropriate distance H1. The print medium applied to the deviation measurement is thin. If the thin paper is set on the same level as the bottom surface of the thick paper, there is a difference in the distance between the thin paper and the thick paper which is equal to the paper thickness difference (H2−H1). That is, the distance increases when the deviation measurement is made.

Figure 8:
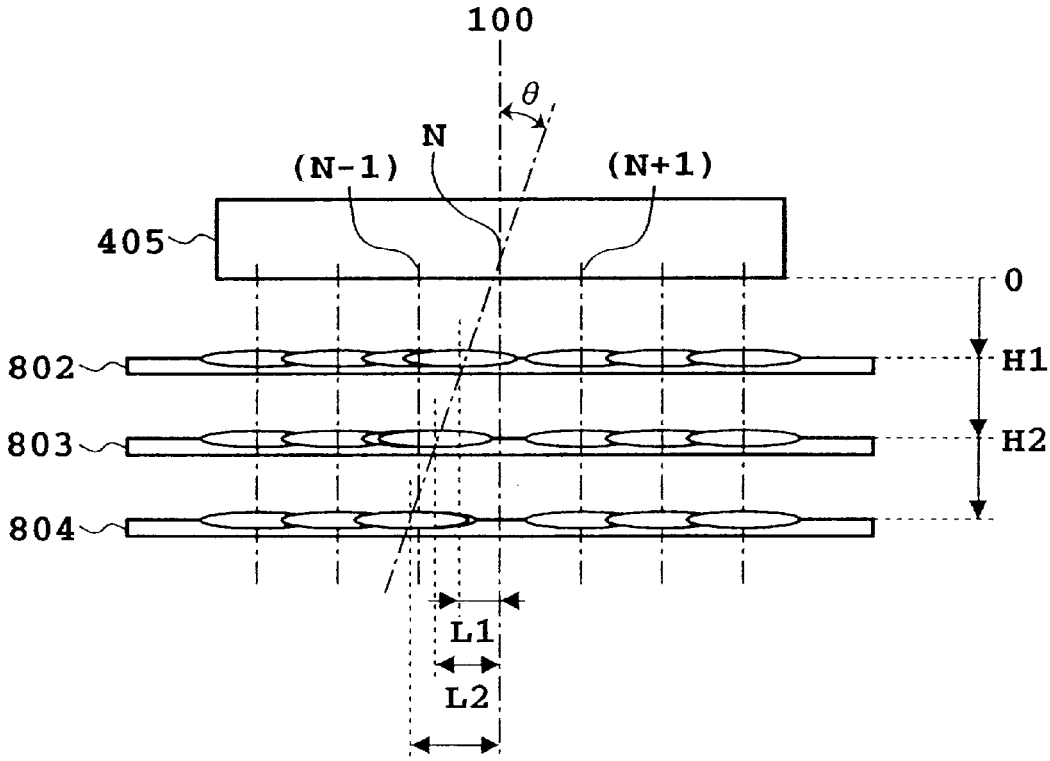
FIG. 8 is an explanatory side view showing an ink droplet landing on a print medium for each distance setting in a third embodiment of the invention.

When the printing is done with an increased distance between the print medium and print head, the resulting increased dot deviation produces a significant density variation in the printed image on the print medium such as a blank line. This in turn allows the user to locate a nozzle in the print head causing the dot deviation easily and reliably. Therefore, the deviation measurement and the normal printing can be selected as needed without having to change the distance between the upper surface of the print medium feeder and the print head FIG. 8 shows a third embodiment of the present invention that detects deviations at a plurality of paper page positions.

As shown in the figure, this embodiment allows the print head 405 to be set either at a first position 802 corresponding to an appropriate normal print distance (first distance) or at one of a plurality of second positions (in this case, two positions 803, 804) corresponding to a plurality of deviation measuring distances (second distance).

In the third embodiment, because there are two deviation measuring positions (two second distances) available, when it is necessary to examine the droplet ejection behavior closely as when the ink droplet ejection path is not linear, the dot deviation can also be measured at the second deviation measuring position 804 to make a more precise check on the deviation.

Others

The present invention achieves distance effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, this invention allows the print head position to be selectively set either to a first distance that produces a normal printed image in which a landing error on the print medium of the ink droplets ejected from the print head is within a predetermined range or to a second paper distance that produces a dot landing error greater than the predetermined range. Thus, selecting the second distance and performing the print operation can produce a significant print error in the printed result on the print medium, so that the user can more clearly grasp the characteristics of the print head. This eliminates the need for a high-performance image reading mechanism that is required with the conventional apparatus, making it possible for the user to understand the ink ejection performance of the print head with low cost and ease.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A printing apparatus for ejecting ink droplets from an ink ejection means onto a print medium to form an image, the printing apparatus comprising:

generation means for generating detection pattern data to detect an ink ejection deviation, the ink ejection deviation being a deviation of a landing position of the ink droplets ejected on the printing medium by the ink ejection means;

detection means for detecting the deviation of the landing position based on the detection pattern data;

distance adjusting means to change a distance between the ink ejection means and the print medium; and control means to set a plurality of different distances by controlling the distance adjusting means, wherein the control means controls the distance adjusting means such that in a case where a detection pattern is formed in order to detect the landing position of ink droplets, the distance between the ink ejection means and the print medium is set to a second distance which is greater than a first distance for performing normal printing.

2. A printing apparatus according to claim 1, wherein the first distance is a distance that results in a normal printed image having a landing error on the print medium of ink droplets ejected from the ink ejection means, and the second distance is a distance that results in a landing error greater than that resulting from the first distance.

3. A printing apparatus according to claim 1, wherein the first distance is a distance that results in a normal printed image and the second distance results in a printed image for observing a landing error of the ink droplets.

4. A printing apparatus according to claim 1, wherein the first distance is a distance that results in adjacent ink droplets joining through penetration of ink as a result of a landing error and the second distance is a distance that results in adjacent ink droplets being separated from each other by an unpenetrated ink area formed between the adjacent ink droplets as a result of the landing error.

5. A printing apparatus according to claim 1, wherein the ink ejection means generates a bubble in the ink by thermal energy and ejects the ink by the generated energy of the bubble.

6. A printing apparatus according to claim 1, further comprising an image memory for storing image data to print an image, including the detection pattern data.

7. A printing apparatus for ejecting ink droplets from an ink ejection means onto a print medium to form an image, the printing apparatus comprising:

generation means for generating detection pattern data to detect an ink ejection deviation, the ink ejection deviation being a deviation of a landing position of the ink droplets ejected on the printing medium by the ink ejection means;

detection means for detecting the deviation of the landing position based on the detection pattern data;

distance adjusting means to change a distance between the ink ejection means and the print medium; and control means to set a plurality of different distances by controlling the distance adjusting means, wherein the control means controls the distance adjusting means such that in a case where a detection pattern is formed in order to detect the landing position of ink droplets, the distance between the ink ejection means and the print medium is set to a second distance which is greater than a first distance for obtaining a normal printed image, and the first distance results in a landing error within a predetermined range while the second distance results in a landing error greater than the predetermined range.

8. A printing apparatus according to claim 7, wherein the distance adjusting means can set from a plurality of first distances and a plurality of second distances, and the first distances are distances that result in normal printed images and at least one of the plurality of second distances results in a printed image for observing a landing error of the ink droplets.

9. A printing apparatus according to claim 7, wherein the first distance is a distance that results in adjacent ink droplets joining through penetration of ink as a result of the landing error and the second distance is a distance that results in adjacent ink droplets being separated from each other by an unpenetrated ink area formed between the adjacent ink droplets as a result of the landing error.

10. A printing apparatus according to claim 7, wherein the ink ejection means generates a bubble in the ink by thermal energy and ejects the ink by the generated energy of the bubble.

11. A printing apparatus according to claim 7, further comprising an image memory for storing image data to print an image, including the detection pattern data.

* * * * *

UNITED STATES PATENT AND TRADEMARK OFFICE

CERTIFICATE OF CORRECTION

PATENT NO. : 6,783,201 B2
DATED : August 31, 2004
INVENTOR(S) : Ninomiya

It is certified that error appears in the above-identified patent and that said Letters Patent is hereby corrected as shown below:

Column 7,
Line 10, “head” should read -- head. --.

Signed and Sealed this

Third Day of May, 2005

JON W. DUDAS
*Director of the United States Patent and Trademark Office*